US005378268A

United States Patent [19]

Wolf et al.

[11] Patent Number: 5,378,268

[45] Date of Patent: Jan. 3, 1995

[54] PRIMER FOR THE METALLISATION OF SUBSTRATE SURFACES

[75] Inventors: Gerhard D. Wolf, Dormagen; Kirkor Sirinyan, Bergisch Gladbach; Wolfgang Henning, Kuerten; Rudolf Merten; Ulrich V. Gizycki, both of Leverkusen; Bruce Benda, Bergisch Gladbach, all of Germany

[73] Assignee: Bayer Aktiengesellschaft, Leverkusen, Germany

[21] Appl. No.: 788,957

[22] Filed: Nov. 7, 1991

[30] Foreign Application Priority Data

Nov. 16, 1990 [DE] Germany ..... 4036591

[51] Int. Cl.[6] ..... C23C 18/18; C23C 18/28

[52] U.S. Cl. ..... 106/1.11; 427/306; 524/398; 524/403; 524/513; 524/539

[58] Field of Search ..... 106/1.11, 1.05–1.29; 427/306; 524/398, 403, 513, 539

[56] References Cited

U.S. PATENT DOCUMENTS

| | | | |
|---|---|---|---|
| 3,560,257 | 2/1971 | Schneble, Jr. et al. . | |
| 3,900,320 | 8/1975 | Rolker et al. | 96/35.1 |
| 4,017,265 | 4/1977 | Taylor . | |
| 4,368,281 | 1/1983 | Brummett et al. . | |

FOREIGN PATENT DOCUMENTS

| | | | |
|---|---|---|---|
| 0081129 | 11/1982 | European Pat. Off. . | |
| 0250867 | 5/1987 | European Pat. Off. . | |
| 0256395 | 7/1987 | European Pat. Off. . | |
| 0322641 | 12/1988 | European Pat. Off. . | |
| 361754 | 4/1990 | European Pat. Off. | C09J 113/00 |
| 2443488 | 9/1974 | Germany . | |
| 3814506 | 4/1988 | Germany . | |

*Primary Examiner*—Paul Lieberman
*Assistant Examiner*—Margaret Einsmann
*Attorney, Agent, or Firm*—Sprung Horn Kramer & Woods

[57] ABSTRACT

Primers, essentially consisting of a film former or matrix former, an additive, an ionic and/or colloidal noble metal, a filler and a solvent, are suitable for coating substrate surfaces for subsequent chemical metallization.

4 Claims, No Drawings

PRIMER FOR THE METALLISATION OF SUBSTRATE SURFACES

BACKGROUND OF THE INVENTION

It is known that polymeric materials must be pretreated before the chemical metallisation and the subsequent electroplating, for example by etching of the polymer surface with chromic and sulphuric acids, which pollute the environment.

EP-A 0,081,129 has also disclosed that an activation, which is obtained by "swelling adhesion activation", leads to well adhering metal deposits. This elegant process has the disadvantage, however, that it causes stress cracking in the case of polymer injection-mouldings of complicated shape. Moreover, this process requires a new swelling activation system for each type of plastic and is thus not universally applicable.

U.S. Pat. No. 3,560,257, U.S. Pat. No. 4,368,281 and U.S. Pat. No. 4,017,265and DE-A 3,627,256 and 2,443,488 have disclosed processes for activation, which use activator solutions which contain adhesion-promoting polymers. The disadvantage of these processes is that they require the use of relatively large quantities of expensive noble metal activators. Moreover, they succeed as desired only in the case of very specific plastics and are therefore also applicable only with restrictions.

For this reason, Pd-containing primers are proposed in EP-A 0,361,754, which require the additional use of chromic and sulphuric acids. Pd-containing primers based on PU (polyurethane) are also known from DE-A 3,627,256. The disadvantage of these elegant processes is that they cause stress cracking of plastic injection-mouldings of complicated shape.

Finally, special adhesion-promoting plastic coatings can be taken from DE-A 3,814,506, but these lead in some cases to extraneous deposition depending on the geometry.

SUMMARY OF THE INVENTION

The object of the present invention was therefore the development of an economical, universally applicable process for chemical metallisation, whereby material surfaces based on glasses, metals and especially plastics can, without previous etching with oxidants, be provided with a well adhering metal coating deposited by wet-chemical means.

The object is achieved in such a way that substrate surfaces are coated with a special primer based on a polymer organic film former or matrix former, which additionally also contains an additive.

This primer essentially consists of a) a film former or matrix former, b) an additive having an overall surface tension in the range of 45–65 mN/m, c) an ionic and/or colloidal noble metal or organometallic covalent compounds thereof or complex compounds with this metal, d) a filler and e) a solvent.

DETAILED DESCRIPTION OF THE INVENTION

The film formers or matrix formers a) used according to the invention are the paint systems which are to be used at room temperature, such as, for example, alkyd resins, unsaturated polyester resins, polyurethane resins, epoxide resins, modified fats and oils, polymers or copolymers based on vinyl chloride, vinyl ethers, vinyl esters, styrene, acrylic acid, acrylonitrile or acrylic esters, cellulose derivatives, or the baking lacquers which crosslink at elevated temperature, such as, for example, polyurethanes from hydroxylated polyethers, polyesters or polyacrylates and masked polyisocyanates, melamine resins from etherified melamine/formaldehyde resins and hydroxylated polyethers, polyesters or polyacrylates, epoxide resins from polyepoxides and polycarboxylic acids, polyacrylates containing carboxyl groups and polyesters containing carboxyl groups, baking lacquers from polyester, polyesterimides, polyester-amide-imides, polyamide-imides, polyamides, polyhydantoins and polyparabanic acids. These baking lacquers can as a rule be applied either as a powder or from solution.

Film formers or matrix formers based on polyurethane systems which are built up from the following components are very particularly suitable:

1. Aliphatic, cycloaliphatic, araliphatic, aromatic and heterocyclic polyisocyanates, such as are described, for example, by W. Siefken in Justus Liebigs Annalen der Chemie, 362, pages 75–136, for example those of the formula $$Q(NCO)_n,$$

in which n=2 to 4, preferably 2 to 3, and

Q denotes an aliphatic hydrocarbon radical having 2 to 18 and preferably 6 to 10 carbon atoms, a cycloaliphatic hydrocarbon radical having 4 to 15 and preferably 5 to 10 carbon atoms, an aromatic hydrocarbon radical having 6 to 15 and preferably 6 to 13 carbon atoms, or an araliphatic hydrocarbon radical having 8 to 15 and preferably 8 to 13 carbon atoms, for example such polyisocyanates as are described in DE-A 2,832,253, pages 10 to 11. The polyisocyanates which are readily accessible industrially are as a rule particularly preferred, for example 2,4-and 2,6-toluylene diisocyanate, and also any desired mixtures of these isomers ("TDI"); polyphenyl-polymethylene polyisocyanates such as are produced by aniline-formaldehyde condensation and subsequent phosgenation ("crude MDI") and polyisocyanates containing carbodiimide groups, urethane groups, allophanate groups, isocyanurate groups, urea groups or biuret groups ("modified polyisocyanates"), especially those modified polyisocyanates which are derived from 2,4-and/or 2,6-toluylene diisocyanate or from 4,4'-and/or 2,4'-diphenylmethane diisocyanate.

2. Compounds having at least two hydrogen atoms reactive towards isocyanates and having a molecular weight of as a rule from 400 to 10,000. In addition to compounds containing amino groups, thiol groups or carboxyl groups, these are to be understood especially as compounds having two to eight hydroxyl groups, especially those of a molecular weight from 1000 to 6000, preferably 2000 to 6000, for example polycarbonates and polyester-amides which contain at least two, as a rule two to eight, but preferably 2 to 6 hydroxyl groups, such as are known per se for producing homogeneous and cellular polyurethanes and are described, for example, in DE-A 2,832,253, pages 11–18.

3. If desired, compounds having at least two hydrogen atoms reactive towards isocyanates and having a molecular weight from 32 to 399. In this case again, these are understood as compounds which contain hydroxyl groups and/or thiol groups and/or amino groups and/or carboxyl groups, preferably compounds which contain hydroxyl groups and/or amino groups and which serve as chain-extending agents or cross-linking agents. These compounds have as a rule 2 to 8 and preferably 2 to 4 hydrogen atoms reactive towards isocyanates. Examples of these are described in DE-A 2,832,253, pages 19–20.

4. If desired, the film former or matrix former can contain auxiliaries and additives such as α) catalysts of the type known per se, β) surface-active additives such as emulsifiers and stabilisers, γ) reaction retarders, for example substances having an acidic reaction, such as hydrochloric acid or organic acid halides, and also cell regulators—of the type known per se—such as paraffins or fatty alcohols or dimethylpolysiloxanes, and also pigments or dyestuffs and flameproofing agents—of the type known per se—for example tris-chloroethyl phosphates, tricresyl phosphate, and also stabilisers against the effects of ageing and weathering, plasticisers and substances having a fungistatic and bacteriostatic activity.

These auxiliaries and additives, which can optionally also be used, are described, for example, in DE-A 2,732,292, pages 21–24.

The quantity employed of the film former or matrix former can be varied within wide limits. As a rule, 3–30% by weight, preferably 4–20% by weight (relative to the total formulation) are employed.

The additives b) used can be organic and/or organometallic polymeric or prepolymeric compounds having a molecular mass of 100–1,000,000, preferably 500–20,000, and an overall surface tension in the range of 45–65 mN/m, preferably 45–60 mN/m and particularly preferably 50–60 mN/m. Their quantity can be varied in a wide range between 0.1 and 15% by weight, relative to the formulation, and 0.3–5% by weight is to be very particularly preferred.

These can be, for example, polymers based on oxazolines such as polyethyloxazoline which is prepared, for example, by cationic polymerisation from methyl tosylate and methyloxazoline. Polymethyl-, polypropyl- and polybutyloxazoline are also outstandingly suitable. Their quantity can be varied in a wide range between 0.1 and 15% by weight, relative to the formulation, and 0.3–5% by weight is to be very particularly preferred.

By way of example, oligomeric polymethacrylic acid or esters thereof such as the butyl, ethyl and methyl esters, polyamides based on adipic acid and hexamethylenediamine, polyethyleneamines, polyethyleneamides, polyester types based on adipic acid, phthalic acid, butanediol and trimethylolpropane and polyacrylates such as polyethyl acrylate and polybutyl acrylate, polyalcohols such as polyvinyl alcohol and their mixtures with one another may be mentioned. Polyester types and aliphatic polyamide types of the viscosity range of 10,000–35,000 cP at 20° C. with a hydroxyl content of 5.5–0.15% or isocyanate-modified derivatives thereof are also very suitable. Polyamines based, for example, on ethylenediamine, propylenediamine and butylenediamine can also be used.

The noble metal complexes c) used in the primers according to the invention are organometallic compounds of subgroups 1 or 8 of the periodic table (in particular Pd, Pt, Au and Ag), such as are described, for example, in EP-A 34,485, 81,438 and 131,195. Organometallic compounds of palladium with olefins (dienes), with α,β-unsaturated carbonyl compounds, with crown ethers, with nitriles and with diketones such as pentane-2,4-dione are particularly suitable. Butadienepalladium dichloride, bis(acetonitrile)palladium dichloride, bis(benzonitrile)palladium dichloride, (4-cyclohexene-1,2-dicarboxylic acid anhydride)palladium dichloride, (mesityl oxide)palladium chloride, (3-hepten-2-one)palladium chloride, (5-methyl-3-hexen-2-one)palladium chloride and (pentane-2,4-dionato)palladium are very particularly suitable.

Moreover, 0-valent complex compounds such as tetrakis(triphenylphosphine) palladium(0) can be used. Salts such as the halides, acetates, nitrates, carbonates, sulphates, sulphides and hydroxides such as, for example, PdS, $Na_2PdCl_4$, $Na_2PdCN_4$, $H_2PtCl_6$, $AgNO_3$, $Ag_2SO_4$ and $Ag_2S$ can be used as ionic noble metals.

As colloidal noble metal systems, reference may be made to Pd black, Pd on carbon, Pd on $Al_2O_3$, Pd on $BaSO_4$ and Pd on activated carbon.

The quantity of the noble metal can be varied widely in the range of 0.05–2.5% by weight, relative to the total formulation. The preferred quantity of noble metal is about 0.1–1.0% by weight.

The fillers d) used can be oxides of the elements Mn, Ti, Mg, Al, Bi, Cu, Ni, Sn, Zn and Si, and also silicates, bentonites, talc and chalk. Preferably, however, those inorganic or organic fillers are preferably used which have a resistance between 0.01 and $10^4$ Ω/cm. Conductive carbon black is the particularly preferred filler. Preferably mixtures of those inorganic or organic fillers are used. The quantity of the filler can be varied widely in the range of 0.5–35, but preferably 3–20 and particularly preferably 5–15% by weight, relative to the mass of the primer.

The solvents e) used in the primers according to the invention are the substances known in printing technology and paint technology, such as aromatic and aliphatic hydrocarbons, for example toluene, xylene and petroleum fractions, glycerol; ketones, for example methyl ethyl ketone and cyclohexanone; esters, for example butyl acetate, dioctyl phthalate and butyl glycolate; glycol ethers, for example ethylene glycol monomethyl ether, diglyme and propylene glycol monomethyl ether; esters of glycol ethers, for example ethylene glycol acetate, propylene glycol monomethyl ether-acetate and diacetone-alcohol. Mixtures of these solvents and blends thereof with other solvents can of course also be used. The quantities employed amount to 50–90% by weight, preferably 60–85% by weight.

The primer according to the invention is in general prepared by mixing of the constituents. The incorporation of the components can also be carried out in separate steps.

The primer can be applied to the plastic surfaces by the conventional methods such as printing, stamping, dipping, brushing, blade application and spraying.

The layer thickness of the primer can vary within the range of 0.1–200 μm, but preferably in the range of 5–30 μm.

In this connection, it should be mentioned explicitly that, due to the use of primers according to the invention, a swelling adhesion treatment of the plastic is not necessary. As a result, the formation of stress cracks is avoided.

Suitable substrates for the process according to the invention are workpieces based on inorganic glasses, metals and especially plastics. Plastics such as are used in the electrical, electronics and domestic sectors are particularly preferred. In this connection, reference may be made to ABS, PC (polycarbonate) and blends thereof and grades with a flameproof finish, such as, for example, Bayblend® FR-90, 1441, 1439 and 1448, polyamide grades, polyester grades, PVC, polyethylene and polypropylene. The flameproof finishing of plastics is known. For example, polybrominated bisphenols and halogenated benzylphosphonates (GB-A 2,126,231, DE-A 4,007,242) are used for this purpose.

The surfaces modified in this way can then be sensitised by reduction. For this purpose, the reducing agents usual in electroplating can preferably be used, such as hydrazine hydrate, formaldehyde, hydrophosphite or boranes. Of course, other reducing agents are also possible. Preferably, the reduction is carried out in aqueous solution. However, other solvents such as alcohols, ethers and hydrocarbons can also be used. Of course, suspensions or slurries of the reducing agents can also be used.

The surfaces activated in this way can be used directly for electroless metallisation. However, it can also be necessary to clean the surfaces by washing off residues of reducing agents.

In a very particularly preferred embodiment of the process according to the invention, the reduction is carried out in the metallisation bath at the same time with the reducing agent of the electroless metallisation. This procedure represents a simplification of electroless metallisation. This very simple embodiment then comprises only the three working steps: dipping of the substrate into the solution of the organic compound or application or spraying of the primer, evaporation of the solvent and dipping of the surfaces thus activated into the metallisation bath (reduction and metallisation).

This embodiment is very particularly suitable for nickel baths containing aminoboranes or copper baths containing formalin.

The metallisation baths which can be used in the process according to the invention are preferably baths with nickel salts, cobalt salts, copper salts, gold salts and silver salts or their mixtures with one another or with iron salts. Such metallisation baths are known in the art of electroless metallisation.

The process according to the invention has the advantage that, even without previous oxidative etching and/or swelling or treatment of the substrate surface with solvents which expand polymer chains, it permits deposition of firmly adhering metal by the subsequent selective electroless metallisation solely with the aid of the primer surface.

The novel process thus allows a deposition, which is compatible with the environment and inexpensive, of metal on the whole or partial surfaces of materials. Materials metallised by the novel process are distinguished by their excellent shielding effect against electromagnetic waves. These materials are used in the electrical, automotive, electronics and domestic sectors.

The good mechanical properties of the polymeric base material, such as impact strength, notched impact strength, and flexural strength are not adversely affected by the coating or metallisation step.

Some of the product names mentioned in the examples which follow are registered trademarks.

EXAMPLE 1

A test panel of 100×100 mm made, of a blend consisting of 60% of a polyester obtained from 4,4'-dihydroxydiphenyl-2,2-propane and carbonic acid and 40% of acrylonitrile/butadiene/styrene copolymer having a Vicat temperature of about 90° C., was provided on one side with a 10 μm thick primer and dried at 80° C. in the course of 45 minutes.

The primer consisted of

- 53.7 parts by weight of polyurethane resin,
- 198 parts by weight of a solvent mixture consisting of toluene, diacetone-alcohol and isopropanol (1:1:1),
- 14.7 parts by weight of titanium dioxide,
- 5.4 parts by weight of talc,
- 5.4 parts by weight of chalk,
- 7.2 parts by weight of carbon black, 20% strength in butyl acetate,
- 6.6 parts by weight of polyester having 4.3% of OH groups and a surface tension of >45 mN/m, 20% strength solution in MEK (methyl ethyl ketone) and DAA (diacetone-alcohol) (1:1),
- 9 parts by weight of a silicate-based suspending agent, 10% strength digestion in xylene, and
- 0.35 part by weight of bis(benzonitrile)palladium(II) dichloride.

The test panel was then treated at 30° C. in a reducing bath, consisting of 10 g of dimethylaminoborane and 1.0 g of NaOH in 1 liter of water, and subsequently copper-plated at room temperature in a chemical copper-plating bath in the course of 30 minutes, washed with distilled water and then heat-treated for 30 minutes at 80° C. A 1.5 μm thick copper layer was thus formed.

This gave a panel metallised on one side. This panel shielded off electromagnetic waves.

The metal deposit adhered to the primer surface so strongly that it very easily passed both the tape test according to DIN 53 151 and the thermal shock test.

The metal deposit also showed a peel strength according to DIN 53 494 of 25 N/25 mm.

EXAMPLE 2

A polyphenylene oxide/polystyrene panel was provided on one side with a primer consisting of

- 53.7 parts by weight of polyurethane resin
- 200 parts by weight of a solvent mixture consisting of toluene, diacetone-alcohol and isopropanol (1:1:1)
- 15 parts by weight of titanium dioxide
- 6 parts by weight of talc
- 8 parts by weight of carbon black, 20% strength in butyl acetate
- 7 parts by weight of poly-2-ethyl-2-oxazoline, 20% strength solution in MEK
- 8 parts by weight of a silicate-based suspending agent, 10% strength digestion in xylene, and
- 0.5 part by weight of 3-(hexen-2-one)palladium chloride, and dried at 80° C. in the course of 45 minutes.

The panel thus coated was provided in a chemical copper-plating bath in the course of 45 minutes with a 2 μm thick Cu deposit.

This gave a plastic panel metallised on one side and having very good metal adhesion.

This panel effectively shielded off electromagnetic waves.

EXAMPLE 3

A test panel of 100×100 mm size made of a blend composed of about 70% of a polyester from 4,4'-dihydroxy-diphenyl-2,2-propane and carbonic acid and about 30% of an acrylonitrile/butadiene/styrene copolymer having a Vicat temperature of about 110° C., was provided according to Example 1 with a paint coating and then with a metal coating. This gave a panel which effectively shielded off electromagnetic waves and had good metal adhesion.

EXAMPLE 4

An ABS panel of 100×100 mm was coated on one side by means of a robot to a thickness of 15 μm with a primer consisting of 50 parts by weight of a polyol component of

- 88.76 parts by weight of a polyester-polyol of molecular weight 2000 from adipic acid, ethylene glycol and 1,4-dihydroxybutane (molar ratio of the diols 70:30)
- 8.0 parts by weight of ethylene glycol
- 0.5 part by weight of water
- 0.5 part by weight of triethylenediamine
- 0.55 part by weight of a commercially available polysiloxane stabiliser
- 1.25 parts by weight of $Na_2PdCl_4$ and
- 1.0 part by weight of tetrabutylammonium chloride and 50 parts by weight of a polyisocyanate component of

- 90.0 parts by weight of an NCO prepolymer of 65.0 parts by weight of 4,4'-diisocyanatodiphenylmethane and 38.0 parts by weight of the polyester-polyol used in the polyol component
- 250.0 parts by weight of a solvent mixture consisting of toluene, diacetone-alcohol and isopropanol (1:1:1)
- 15.0 parts by weight of chalk
- 8.0 parts by weight of carbon black, 20% strength in butyl acetate, and
- 10.0 parts by weight of a polyester containing 3.2% of OH groups and having a surface tension of >48 mN/m, 20% strength solution in methyl ethyl ketone and diacetone-alcohol (1:1), then copper-plated according to Example 1 and heat-treated at 70° C. for 20 minutes. This gave a plastic panel which shielded off electromagnetic waves and had good metal adhesion. The adhesion of the metal coating was 20 N/25 mm.

EXAMPLE 5

A polycarbonate test panel of 100×150 mm was provided with an approximately 15 μm thick primer coat and dried in the course of 30 minutes at 65° C.

The primer consisted of

- 50 parts by weight of a physically drying 1-component polyurethane resin,
- 750 parts by weight of a solvent mixture consisting of toluene, diacetone-alcohol and isopropanol (1:1:1),
- 55 parts by weight of titanium dioxide,
- 25 parts by weight of talc,
- 25 parts by weight of chalk,
- 50 parts by weight of the polyamide hot-melt adhesive made by Schering of the type Eurolen 2140, 20% strength solution in MEK: DAA=1:1, and
- 4 parts by weight of silver nitrate.

After drying, the test panel was copper-plated in the course of 30 minutes in a chemical copper-plating bath, washed with water and then dried at room temperature.

A 2 μm thick copper layer had formed which had a peel strength of 15 N/25 mm according to DIN 53 494.

This metallised panel shielded off electromagnetic waves.

What is claimed is:

1. A primer for the chemical metallization of glass, metal, or plastic surfaces, consisting essentially of a) 3–30 percent by weight of a film former or matrix former selected from the group consisting of
   i. polyurethane resins, and
   ii. polymers or copolymers based on styrene, acrylic acid, acrylonitrile or acrylic esters;

b) 0.1–15 percent by weight of an additive having a molecular weight of 500–20,000 and an overall surface tension in the range of 45–65 mN/m, selected from the group consisting of a polyester based on adipic acid or phthalic acid and butanediol or trimethylolpropane, a polyamide, polyethyl oxazoline, polymethyl oxazoline, polypropyl oxazoline, polybutyl oxazoline and mixtures thereof;

c) 0.05–2.5 percent by weight of an ionic or colloidal noble metal or mixture thereof or a covalent compound or complex compound thereof with organic ligands;

d) 0.5–35 percent by weight of an organic or inorganic filler or a mixture thereof; and e) 50–90 percent by weight of an organic solvent.

2. The primer of claim 1 wherein the film former consists of a polyurethane.

3. The primer of claim 1, which contains a silicate or a conductive carbon black or a mixture thereof as the filler.

4. A primer according to claim 1 wherein component c) is an organometallic complex compound or a complex with an organic ligand.

* * * * *